US008610532B2

(12) United States Patent
Singh et al.

(10) Patent No.: US 8,610,532 B2
(45) Date of Patent: Dec. 17, 2013

(54) CORROSION-RESISTANT COATING SYSTEM FOR A DRY-TYPE TRANSFORMER CORE

(75) Inventors: Bandeep Singh, Wytheville, VA (US); Thomas A. Hartmann, Wytheville, VA (US); Robert C. Ballard, Wytheville, VA (US)

(73) Assignee: ABB Technology AG, Zurich (CH)

( * ) Notice: Subject to any disclaimer, the term of this patent is extended or adjusted under 35 U.S.C. 154(b) by 50 days.

(21) Appl. No.: 13/336,283

(22) Filed: Dec. 23, 2011

(65) Prior Publication Data

US 2013/0162386 A1 Jun. 27, 2013

(51) Int. Cl.
*H01F 27/24* (2006.01)

(52) U.S. Cl.
USPC ..... 336/219; 336/234

(58) Field of Classification Search
USPC ..... 336/219, 234
See application file for complete search history.

(56) References Cited

U.S. PATENT DOCUMENTS

| | | | | |
|---|---|---|---|---|
| 1,926,865 | A * | 9/1933 | Bushnell et al. | 336/198 |
| 2,718,049 | A * | 9/1955 | Prache | 29/609 |
| 2,847,333 | A * | 8/1958 | Geshner | 427/104 |
| 3,074,039 | A * | 1/1963 | Ford | 336/213 |
| 3,456,224 | A * | 7/1969 | Horstman | 336/211 |
| 4,008,409 | A * | 2/1977 | Rhudy et al. | 310/45 |
| 4,100,521 | A * | 7/1978 | Hori | 336/100 |
| 4,124,834 | A * | 11/1978 | Walsh | 336/58 |
| 4,479,104 | A * | 10/1984 | Ettinger et al. | 336/219 |
| 5,275,645 | A | 1/1994 | Ternoir et al. | |
| 6,344,273 | B1 * | 2/2002 | Satsu et al. | 428/403 |
| 6,917,275 | B2 * | 7/2005 | Ono et al. | 336/234 |
| 7,210,218 | B2 | 5/2007 | Weber et al. | |
| 7,471,182 | B2 | 12/2008 | Kumano et al. | |
| 2002/0084879 | A1 | 7/2002 | Weber et al. | |
| 2011/0248808 | A1 | 10/2011 | Singh et al. | |

FOREIGN PATENT DOCUMENTS

WO WO2010112081 10/2010

OTHER PUBLICATIONS

J.M. Keijman, "The evolution of siloxane epoxy coatings in the protective coatings industry," pp. 1-10, published at http://ppgamercoatus.ppgpmc.com/techcenter/docs/Evolutionofsiloxaneepoxycoatings.pdf.

* cited by examiner

*Primary Examiner* — Tsz Chan
(74) *Attorney, Agent, or Firm* — Melissa J. Szczepanik

(57) ABSTRACT

A protective coating system for application to exposed surfaces of a transformer core prevents corrosion of the core. The protective coating is suitable for use in industrial and marine environments where many factors impact the life of the transformer core. The protective coating comprises at least three coating layers. The first coating layer is an inorganic zinc silicate primer. The second coating layer is a polysiloxane. The third coating layer is a room temperature or high temperature vulcanizing silicone rubber. A silicone rubber sealant may be further applied to outer edge surfaces of the core.

13 Claims, 4 Drawing Sheets

CORROSION-RESISTANT COATING SYSTEM FOR A DRY-TYPE TRANSFORMER CORE

FIELD OF INVENTION

The present application is directed to a protective coating system for application to transformer cores, more particularly for application to dry-type transformer cores.

BACKGROUND

Dry-type transformers are often exposed to corrosive environments in both indoor and outdoor applications such as industrial or marine environments. Environmental and industrial factors such as pollution, rain, snow, wind, dust, ultraviolet rays, and sea spray contribute to the degradation of protective layers applied to the transformer. The active parts of the transformer such as the core are especially susceptible to corrosion due to the aforementioned corrosive agents in combination with the high operating temperatures and vibrations of the core while the transformer is in service.

Prior art coatings have been known to degrade, crack and contribute to de-lamination of the ferromagnetic material used to construct the core. Therefore, there is a need in the art for improvement in corrosion-resistant coatings for dry-type transformer cores.

SUMMARY

A corrosion-resistant coating for a transformer core, the transformer core comprising a ferromagnetic core having top and bottom yokes, and at least one core leg, the ferromagnetic core having outer surfaces exposed to the surrounding environment, a first coating layer forming a barrier between the core outer surfaces and a second coating layer, the second coating layer forming a barrier between the first coating layer and a third coating layer; and the third coating layer forming a barrier between the second coating layer and the surrounding environment.

A method of forming a transformer core wherein the core is coated with a protective coating, the method comprising providing a transformer core, coating the transformer core with a first coating layer comprised of an inorganic zinc silicate, coating the transformer core with a second coating layer comprised of a polysiloxane; and coating the transformer core with a third coating layer comprised of a room temperature curable silicone rubber.

BRIEF DESCRIPTION OF THE DRAWINGS

In the accompanying drawings, structural embodiments are illustrated that, together with the detailed description provided below, describe exemplary embodiments of a protective coating system for a dry-type transformer core. One of ordinary skill in the art will appreciate that a component may be designed as multiple components or that multiple components may be designed as a single component.

Further, in the accompanying drawings and description that follow, like parts are indicated throughout the drawings and written description with the same reference numerals, respectively. The figures are not drawn to scale and the proportions of certain parts have been exaggerated for convenience of illustration.

DETAILED DESCRIPTION

Figure 1:
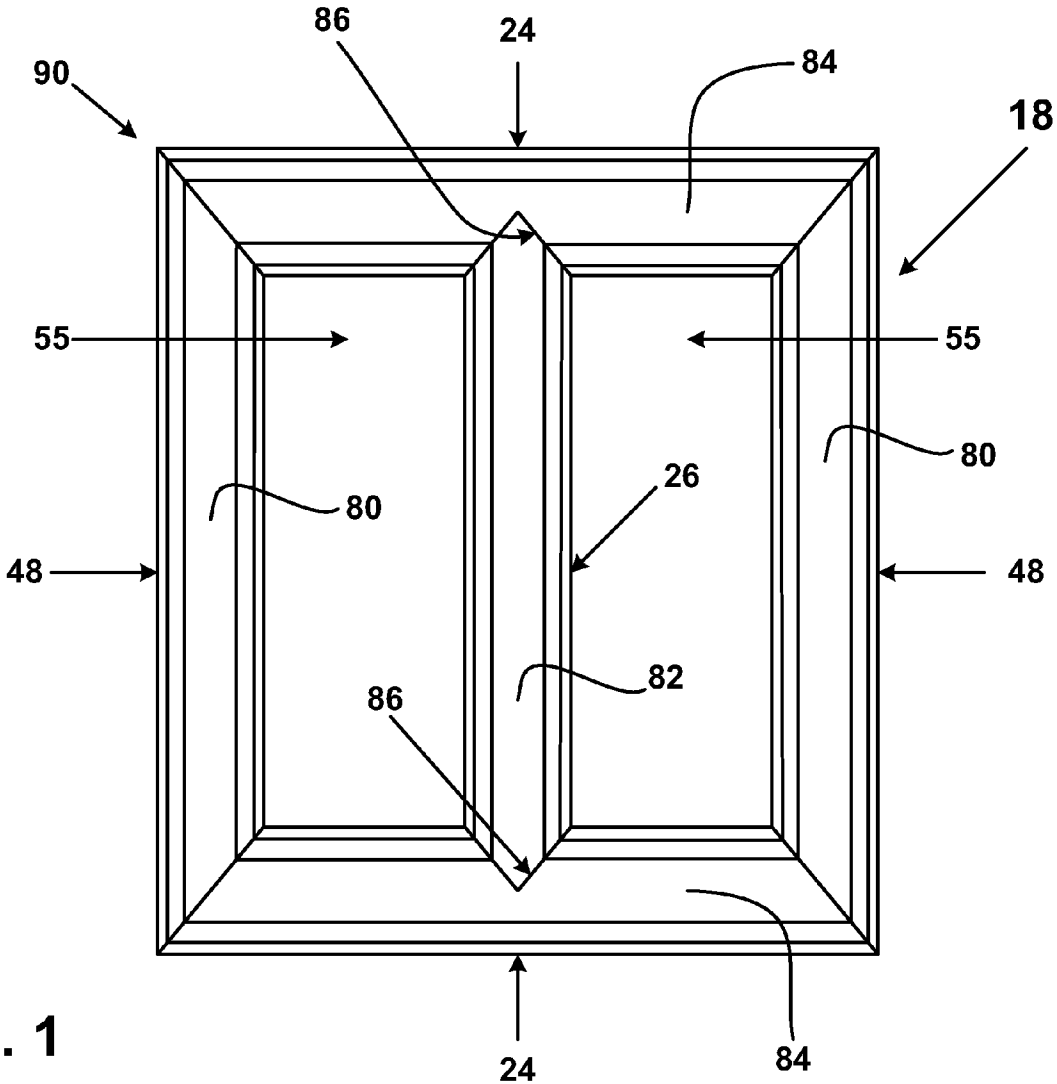
FIG. 1 shows an exemplary linear core of a three-phase dry-type transformer.

Referring to FIG. 1, an exemplary core 18 of a three-phase dry-type transformer 10 is shown. It should be understood that although a core 18 with a split inner leg 26 is shown, the coating system 60 to be described herein is suitable for application to various core 18 configurations. The core 18 is comprised of plurality of laminations that are stacked. The laminations 90 are comprised of a ferromagnetic material such as silicon steel or amorphous metal.

The laminations 90 are comprised of leg and yoke plates 80, 82, 84 that are stacked to form upper and lower yokes 24 and inner and outer core legs 26, 48. The leg plates 82 of the split inner core leg 26 fit into notches 86 formed in the upper and lower yokes 24. Each lamination 90 has openings (not shown) punched therein to allow the stacked laminations 90 to be connected together using bolts or other fastening means. An assembled core 18 has at least one core leg 26, 48 connected to upper and lower core yokes 24.

Alternatively, the core may be wound using strips of ferromagnetic material wherein the strips are cut to a predetermined size and formed into a rounded or rectangular shape, and annealed.

It should be understood that the dry-type transformer having a core 18 protected by the corrosion resistant coating system 60 may be embodied as a single phase transformer, a three-phase transformer or as a three-phase transformer comprised of three single-phase transformers. Alternatively, the transformer 10 may be embodied as a three-phase transformer having a non-linear core 18, such as is shown in FIG. 2.

Figure 2:
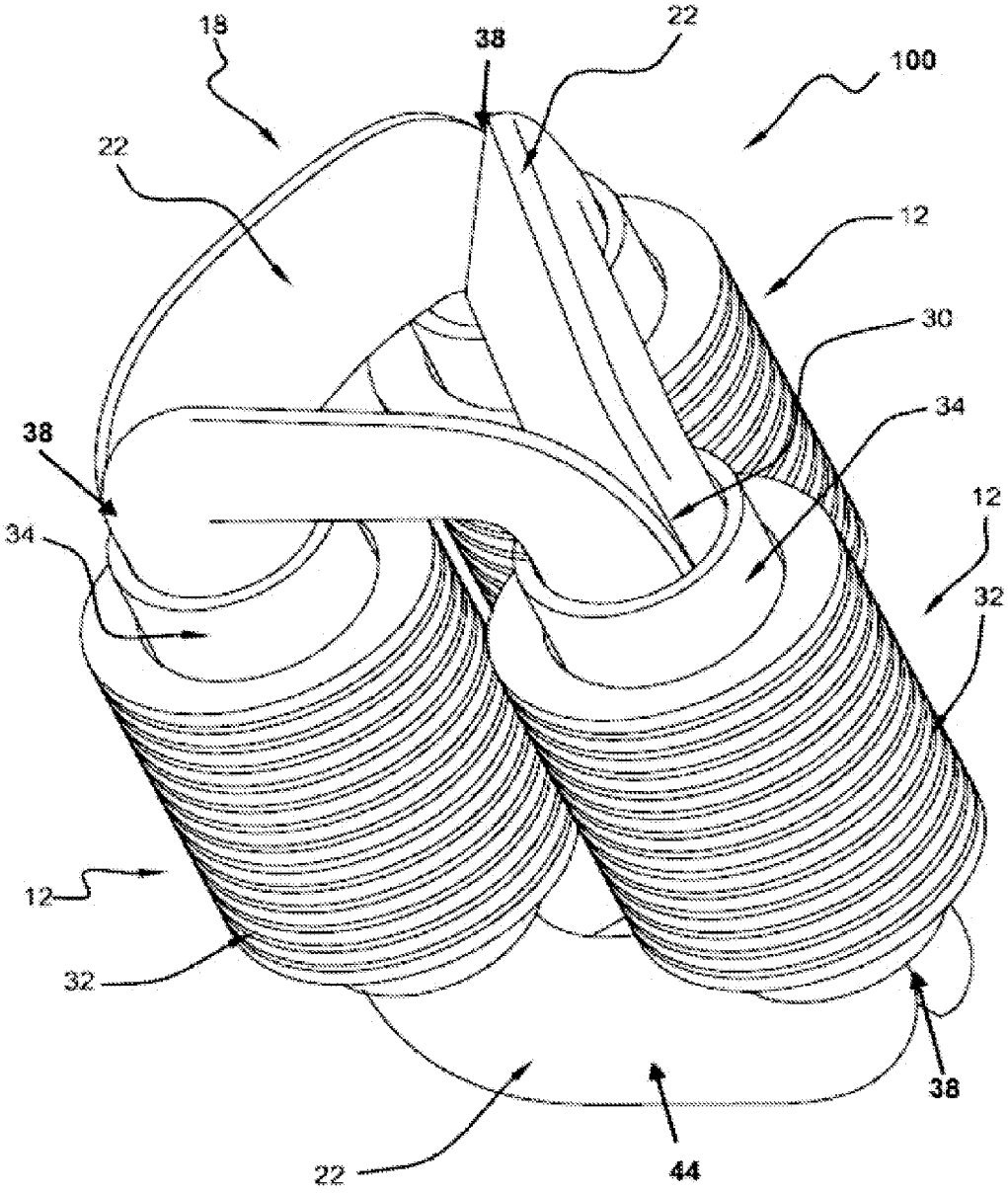
FIG. 2 shows an exemplary dry-type transformer having a non-linear core.

For explanatory purposes, FIG. 2 depicts an exemplary non-linear transformer 100 that has three phases. At least three core frames 22 comprise the ferromagnetic core 18 of the non-linear transformer 100. Each of the at least three core frames 22 are wound from one or more strips of metal such as silicon steel and/or amorphous metal. Each of the at least three core frames 22 has a generally rounded rectangular shape and is comprised of opposing yoke sections 44 and opposing leg sections (not shown). The leg sections are substantially longer than the yoke sections 44. The at least three core frames 22 are joined at abutting leg sections to form core legs 38. The result is a triangular configuration that is apparent when viewing the transformer from above.

After the core 18 of the non-linear transformer 100 is assembled, coil assemblies 12 are mounted to the core legs 38, respectively. Each coil assembly 12 comprises a high voltage winding 32 and a low voltage winding 34. The low voltage winding 34 is typically disposed within and radially inward from the high voltage winding 32. The high and low voltage windings 32, 34 are formed of a conductive material such as copper or aluminum. The high and low voltage windings 32, 34 are formed from one or more sheets of conductor, a wire of conductor having a generally rectangular or circular shape, or a strip of conductor.

In order to apply the at least three layers of the coating system 60 to the core 18 configurations depicted in FIGS. 1 and 2, the core 18 is first assembled, without the coil assemblies 12 being mounted thereon. The corrosion resistant coating system 60 is applied to the outer surfaces of the transformer core 18. The outer surfaces of the core 18 comprise all exposed surfaces of the upper yoke 24, lower yoke 24, inner leg 26 outer legs 48 including the inside surfaces of the core windows 55 shown in FIG. 1. The exposed surfaces are coated with the at least three layers of the coating system 60 and are allowed to fully dry before mounting coil assemblies 12 to the inner and outer core legs 26, 48 of the transformer.

The exposed surfaces of the non-linear transformer of FIG. 2 include the outer surfaces of the at least three core frames 22 except the surfaces of the abutting core leg portions that make contact to form core legs 38.

The corrosion resistant coating system 60 is suitable for application on the outer surfaces of the core 18 of a transformer that is located in an indoor or outdoor application. However, the corrosion resistant coating system 60 is especially designed for harsh environments characterized by one or more of the following environmental and industrial factors: pollution, rain, snow, wind, dust, ultraviolet rays, sand and sea spray.

Figure 3:
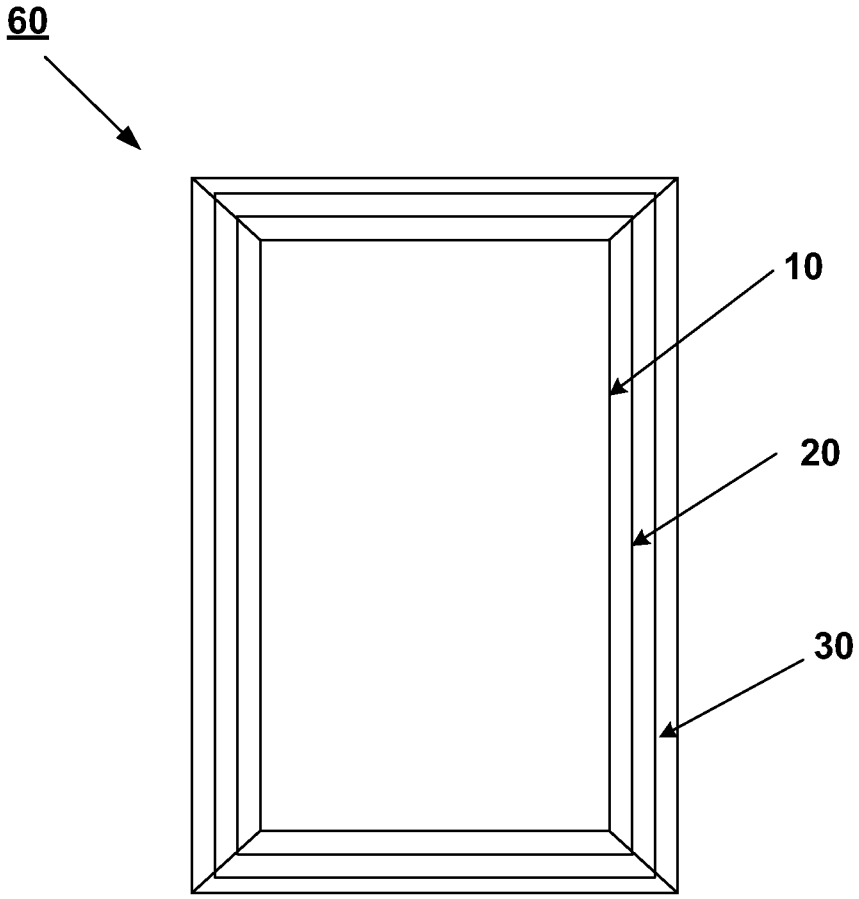
FIG. 3 is a side sectional view of a yoke of the exemplary linear core of FIG. 1 having at least three layers of a coating system embodied in accordance with the present invention.

The corrosion resistant coating system 60 is applied in at least three layers to the core 18 as depicted in FIG. 3. The at least three layers comprise a first coating layer 10 of a zinc silicate primer, a second coating layer 20 having a polysiloxane composition, and a third coating layer 30 comprising a room temperature vulcanizing silicone rubber composition.

Figure 4:
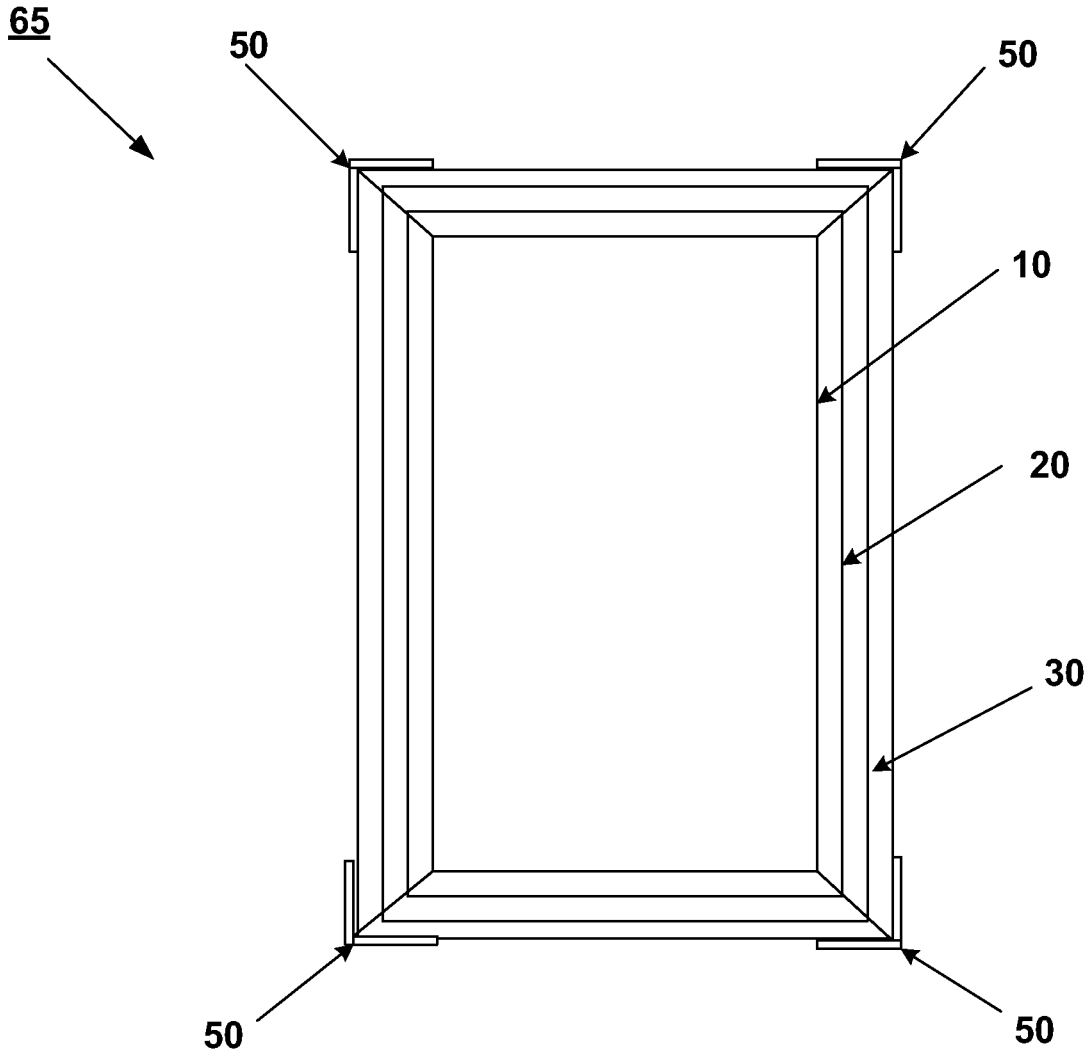
FIG. 4 shows a layer of silicone sealant applied to the outside edges of the yoke of FIG. 3 following the application of the at least three layers of the coating system.

As depicted in FIG. 4, a sealant 50 may be applied to the corners and edges of the assembled core 18 after the at least three layers of the corrosion-resistant coating system 60 are applied to form protective coating 65.

The first coating layer 10 is comprised of an inorganic zinc silicate primer that is applied directly to the ferromagnetic core 18. An example of a primer suitable for the first coating layer 10 is Dimetcote® 9, available from PPG of Pittsburgh, Pa. The desired dry film thickness for the first coating layer 10 is from about 10 microns to about 15 microns. The first coating layer 10 requires about 20 minutes of drying time before applying the second coating layer 20. The first coating layer 10 forms a barrier between the outer surfaces of the core 18 and a second coating layer 20.

The second coating layer 20 is comprised of a polysiloxane composition. An example of a top coat suitable for the second coating layer 20 is PSX® 700 available from PPG of Pittsburgh, Pa. The desired dry film thickness for the second coating layer 20 is from about 10 microns to about 20 microns. The second coating layer 20 requires up to twenty-four hours curing time. If more than one layer of second coating layer 20 is applied, a drying time for each layer of about 20 to about 25 minutes is required. The second coating layer 20 forms a barrier between the first coating layer 10 and a third coating layer 30.

The third coating layer 30 is comprised of a single component room temperature vulcanizing silicone rubber. An example of a coating suitable for the third coating layer 30 is Siltech 100HV, available from the Silchem Group of Encinitas, Calif. Another example of a room temperature vulcanizing silicone rubber coating suitable for the third coating layer 30 is Si-COAT® 570™, available from CSL Silicones Inc. of Guelph, Ontario, Canada. The third coating layer 30 becomes touch dry after one hour and cures within 24 hours. The third coating layer 30 requires at least one hour of drying time before coil assemblies comprised of low and high voltage windings 34, 32, respectively, may be mounted to the inner and outer core legs 26, 48. The desired dry film thickness for the third coating layer 30 is from about 20 microns to about 25 microns. The third coating layer 30 forms a barrier between the second coating layer 20 and the surrounding environment.

Alternatively, the third coating layer 30 may be either a low temperature vulcanizing silicone rubber or a high temperature vulcanizing silicone rubber base in combination with a hardenable cement filler and at least one mineral oxide filler as disclosed in WO20100112081, hereby incorporated by reference in its entirety.

The silicone rubber composition of the alternative third coating layer 30 may be comprised of a base having a low temperature vulcanized silicone rubber or a high temperature vulcanized silicone rubber, filler materials and other optional additives. The base may alternatively comprise a silicone rubber composition that cures during air drying. The silicone rubber base composition is preferably a vulcanized polydimethylsiloxane. It should be understood that the dimethyl group of the polydimethylsiloxane may be substituted with a phenyl group, an ethyl group, a propyl group, 3,3,3-trifluoropropyl, monofluoromethyl, difluoromethyl, or another composition suitable for the application or as disclosed in WO20100112081.

The filler materials are comprised of a hardenable cement filler and at least one mineral oxide filler. The weight ratio of the hardenable cement and the at least one mineral oxide filler is from about 10 parts by weight to about 230 parts by weight per 100 parts by weight of silicone base. The weight ratio of the hardenable cement filler to the at least one mineral inorganic oxide filler is from about 3:1 to about 1:4.

Examples of hardenable cement filler suitable for use in the application are limestone, natural aluminum silicate, clay, or a mixture of the foregoing. Examples of mineral oxide fillers suitable for use in the application are silica, aluminum oxide, magnesium oxide, alumina trihydrate, titanium oxide, or a mixture of silica and aluminum oxide. Optional additives suitable for the application are stabilizers, flame retardants, and pigments.

Each of the first, second, and third coating layers 10, 20, 30 may be applied using a brush, spray, roller, by dipping the core 18 in a vat holding the respective coating compositions, or by pouring the coating composition over the core 18 while the core 18 is being rotated. The drying time required between applications of each coating layer is from about 20 min to about 25 min. All coats are room temperature curable or curable via air drying unless a high temperature vulcanizing silicone rubber composition is used as the silicone base in the alternative third coating layer 30.

A sealant layer 50 may be applied to the edges and corners of the assembled core 18. The sealant layer 50 is comprised of a room temperature vulcanizing silicone rubber. An example of a room temperature vulcanizing silicone rubber sealant suitable for the application is Dow Corning® RTV 732 multipurpose sealant available from Dow Corning of Midland, Mich.

The inventors performed 1,000 hours of salt fog testing on a sample comprised of a plurality of assembled yoke plates 84 comprised of silicon steel. The plurality of assembled yoke plates 84 was coated on all outside surfaces with the at least three layers of the corrosion resistant coating system 60. The at least three layers of the corrosion resistant coating system 60 were allowed to dry for at least 20 minutes between coats. The sample further comprised a glass fiber-reinforced polyester (GFRP) resin sheet placed on each end face of the plurality of yoke plates 84. The yoke plates and GFRP resin sheets were held together by bolts placed through openings in the yoke plates 84 and GFRP resin sheets, the bolts being coated with the at least three layers of the coating system 60. The salt fog test was performed in a salt fog chamber wherein the pH of the water was set at from about 6.5 to about 6.8 and the temperature of the chamber was about 32 degrees Celsius.

The salt fog testing included alternating five days of the enclosed salt fog chamber with two days of an open chamber wherein the samples were exposed to UV light and oxygen. The enclosed salt fog chamber testing was alternated with the open chamber testing until a period of 1,000 hours of salt fog testing was achieved.

The results of the salt fog testing showed that the samples exhibited minimal corrosion. Corrosion was found along the inside portions of the openings where contact between the bolts and the openings prevented the corrosion resistant coating from adhering to the surface.

The protective coating system 60 may be used in pad-mounted, pole-mounted, substation, network, distribution and other utility applications.

It should be appreciated that in addition to the core 18 having the protective coating system 60, the top and bottom core clamps (not shown) may also be coated with the first, second and third coating layers 10, 20, 30 of the coating system 60 to prevent corrosion. The top and bottom core clamps are used to secure the assembled core 18 of the transformer.

The finished dry-type transformer having a core 18 coated with the corrosion resistant coating system 60 should not be operated until four days have passed from the application of the corrosion resistant coating system 60.

In an application wherein the first and/or second coating layers 10, 20 require a lower viscosity, a solvent such as V. M. and P. Naphtha may be used as a thinning agent.

While the present application illustrates various embodiments, and while these embodiments have been described in some detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative embodiments, and illustrative examples shown and described. Accordingly, departures may be made from such details without departing from the spirit or scope of the applicant's general inventive concept.

What is claimed is:

1. A transformer core having a corrosion-resistant coating system, said transformer core comprising: a ferromagnetic core comprised of top and bottom yokes, and at least one core leg, said ferromagnetic core having outer surfaces exposed to the surrounding environment; a first coating layer forming a barrier between said core outer surfaces and a second coating layer; said second coating layer forming a barrier between said first coating layer and a third coating layer, said third coating layer comprised of a room temperature vulcanizing silicone rubber and a filler material, said filler material comprised of a hardenable cement filler and at least one mineral oxide, said hardenable cement filler further comprised of limestone and natural mineral silicates; and said third coating layer forming a barrier between said second coating layer and the surrounding environment.

2. The transformer core of claim 1 wherein said first coating layer is an inorganic zinc silicate.

3. The transformer core of claim 1 wherein said second coating layer is a polysiloxane.

4. The transformer core of claim 1 wherein said first coating layer has a thickness of between about 10 microns to about 15 microns.

5. The transformer core of claim 1 wherein said second coating layer has a thickness of between about 10 microns to about 20 microns.

6. The transformer core of claim 1 wherein said third coating layer has a thickness of between about 20 microns to about 25 microns.

7. The transformer core of claim 1 wherein said core is comprised of edge surfaces where said yokes and said at least one core leg are joined, said edge surfaces further comprising outer edges of said yokes and legs, said edge surfaces coated by a sealant.

8. The transformer core of claim 7 wherein said sealant is a room temperature vulcanizing silicone rubber composition.

9. The transformer core of claim 1 wherein said room temperature vulcanizing silicone rubber is a polydimethylsiloxane.

10. The transformer core of claim 1 further comprising an additive, said additive selected from the group consisting of stabilizer, flame retardant, color and pigment.

11. The transformer core of claim 1 wherein in the mineral oxide is selected from the group consisting of silica, aluminum oxide, magnesium oxide, alumina trihydrate, titanium oxide, a mixture of any two or more of silica, aluminum oxide, magnesium oxide, alumina trihydrate, titanium oxide, and a mixture of all of silica, aluminum oxide, magnesium oxide, alumina trihydrate, titanium oxide.

12. The transformer core of claim 1 wherein the natural mineral silicates are selected from the group consisting of clay, a natural aluminum silicate, or a mixture of clay and natural aluminum silicate.

13. The transformer core of claim 1 wherein the third coating layer is comprised of a high temperature vulcanizing silicone rubber and a hardenable cement filler.

* * * * *